United States Patent [19]

Mori et al.

[11] Patent Number: 4,764,209

[45] Date of Patent: Aug. 16, 1988

[54] METHOD FOR MANUFACTURING ALLOY

[75] Inventors: Kentaro Mori; Hideaki Mizukami; Hirotaka Nakagawa; Akichika Ozeki; Takaho Kawawa, all of Tokyo, Japan

[73] Assignee: Nippon Kokan Kabushiki Kaisha, Tokyo, Japan

[21] Appl. No.: 92,679

[22] Filed: Sep. 3, 1987

[30] Foreign Application Priority Data

Sep. 9, 1986 [JP] Japan ..... 61-210731

[51] Int. Cl.[4] ..... C22B 4/00; C21C 5/52

[52] U.S. Cl. ..... 75/10.26

[58] Field of Search ..... 75/10.23

[56] References Cited

U.S. PATENT DOCUMENTS

| | | | |
|---|---|---|---|
| 2,303,973 | 1/1942 | Armstrong | 75/10.23 |
| 3,305,923 | 2/1967 | Zimmer | 75/10.23 |
| 3,933,474 | 1/1976 | Ham | 75/10.23 |
| 3,947,265 | 3/1976 | Guzowski | 75/10.23 |

*Primary Examiner*—Peter D. Rosenberg

*Attorney, Agent, or Firm*—Frishauf, Holtz, Goodman & Woodward

[57] ABSTRACT

A method for manufacturing alloy comprising: allowing a consumable electrode consisting a single metal element to form a pair of electrodes which have the same element, to set plurality of the pair so that an electrode metal element of each of the plurality of the pair may be different from one another; generating arc between the electrodes in a non-oxidizing atmosphere, to allow the consumable electrodes to be melted at their top ends; and allowing molten drops produced by the melting to go down into a mold to form molten metal, and the molten metal to be cast into alloy consisting of two metal elements. Two pairs consisting of the consumable electrodes allow the two consumable electrodes to be set on an axis, with a predetermined distance between their top ends, on horizontal plane above the mold.

The two pairs of the consumable electrodes are alternated by three pairs of the consumable electrodes when alloy consisting of three metal elements.

15 Claims, 2 Drawing Sheets

METHOD FOR MANUFACTURING ALLOY

BACKGROUND OF THE INVENTION

1. Field of the Invention

The present invention relates to a method for manufacturing an alloy consisting of two or more metal elements and, more particularly to a method wherein an arc is generated between pairs of single metal electrodes to manufacture the alloy.

2. Description of the Prior Art

In general, titanium alloy, as a structural material, is manufactured by a method wherein sponge titanium is mixed with other metal elements, and then is compacted into a consumable electrode. This electrode is melted, by means of a vacuum arc furnace. Thus, titanium alloy is obtained. In the case of manufacture of Nb-Ti alloy, however, if the Nb content is 10 wt.% or more, compacting of Nb will become impossible. Therefore, Nb-Ti alloy containing 50 wt% or more Nb, used for superconductive fine wire, is manufactured as an ingot by a method wherein:

(1) Firstly, Ti-sheet and Nb-sheet are cut to form a joined shape meeting a designated metal composition, and then, those multiple cut pieces are combined into melting materials:

(2) Those melting materials are set as consumable electrodes in a vacuum arc furnace, and then, an arc is generated between the melting materials and the mold. Through this process, the melting materials, as consumable electrodes, are cast into an ingot by melting in the mold; and (3) A plurality of these ingots are firmly welded to form a block. This block is remelted, as a consumable electrode, in a vacuum arc furnace.

This method, however, is disadvantageous in that, since a melting electrode with a desired metal composition has to be prepared in advance, the production costs are high and still, the operational efficiency low. In other words, because Nb-sheet and Ti-sheet are cut to meet predetermined sizes, the yield ratio goes down. In addition to the high price of the metal, this low yield increases the production cost. Further, since the Ni-sheet and Ti-sheet are welded together, the work becomes so complicated that the work efficiency is quite impaired. Materials in the process also are in danger of being polluted by the atmosphere of the welding or the electrode of the welder.

Moreover, in this method, Niobium and Titanium are hard to homogeneously melt. Nb has a melting point higher than that of Ti by approximately 800° C. Owing to this, when the Nb-sheet and Ti-sheet are melted by an arc as an electrode, a phenomenon that titanium with lower melting point is preferentially melted occurs. Resultantly, without normal melting of Nb-sheet, small unmelted pieces of the Nb-sheet often drop into a mold. Then, the small pieces are so hard to be melted in the molten bath of Nb-Ti alloy contained in the mold being cooled that they remain unmelted in the state of being caught on the surface of the solidification boundary. Those remaining pieces are not melted in the following second and third melting processes even though they are so minute as 1 mm or less. Those pieces exist in a final ingot and become defects.

A a kind of vacuum arc furnace method, is disclosed in Japanese Patent Application Laid Open (KOKAI) No. 165271/80, wherein two melting materials workable as electrodes are horizontally and parallelly positioned to allow an arc to be generated between the two electrodes. The electrodes are thereby melted, and molten drops of the electrodes are cast directly into a mold. This method, however, has a requirement that its electrodes are made of an alloy produced in advance, and, in this point, is different from the present invention.

SUMMARY OF THE INVENTION

It is an object of the present invention to provide a method for manufacturing high quality alloy metal at low cost.

In accordance with the present invention, a method is provided for manufacturing alloy metal comprising:

providing a pair of spaced apart consumable electrodes, each electrode consisting of the same single metal element, and arranging a plurality of pairs of said electrodes, the single metal element of each pair being different from one another; generating an arc between the two consumable electrodes of each of said plurality of pairs of electrodes in a non-oxidizing atmosphere, to cause the two consumable electrodes of each pair to be melted at the ends of each of the two consumable electrodes which face each other; and collecting molten drops produced by the melting in a mold to form a molten metal in the mold, the molten metal being cast into an alloy consisting of two or more of said single metal elements.

The above object and other objects and advantages will become more apparent from the detailed description to follow, taken in conjunction with the appended drawings.

DESCRIPTION OF THE PREFERRED EMBODIMENT

Figure 1:
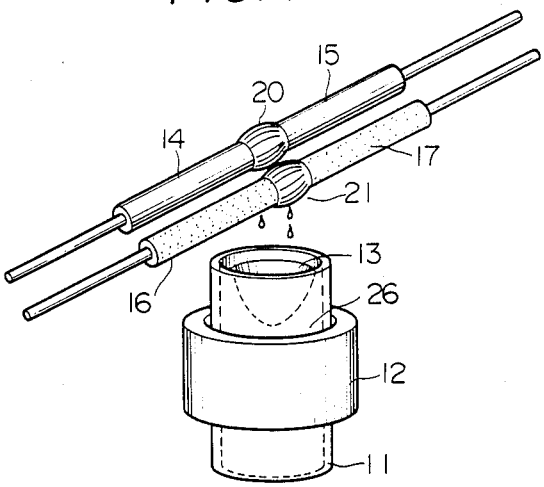
FIG. 1 is a perspective view showing an embodiment of a method of the present invention.
Figure 2:
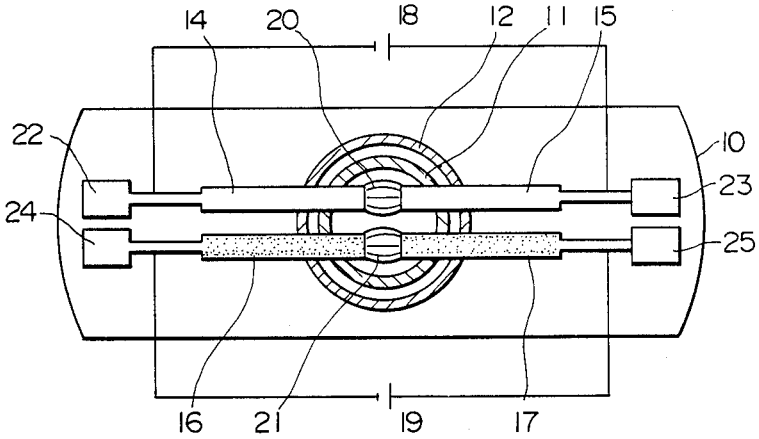
FIG. 2 is a plan view showing the embodiment of the method illustrated in FIG. 1.

Referring now specifically to FIGS. 1 and 2 of the drawings an embodiment of the present invention will be explained.

FIG. 1 perspectively illustrates a method of carrying out the present invention. FIG. 2 shows a plan view of the embodiment of FIG. 1.

The embodiment FIGS. 1 and 2 shows specifically to a manufacturing method of Nb-Ti metal alloy. Chamber 10 acommodates copper mold 11 being water-cooled and electrodes 14 to 17. This chamber is connected with gas exhausting means (not shown) to keep the inside of the chamber at a vacuum. Mold 11 is surrounded by magnetic coil 12 which gives molten metal 13 a magnetic field for stirring. The coil is allowed to move up and down vertically and optionally to stirr the molten metal effectively. Above mold 11, two consumable electrodes 14, 15 consisting of a single and the same metal element, which form one pair, are set in series on line with a predetermined distance between facing ends of the two consumable electrodes. Two pairs of the single elemental and same two electrodes are set parallely on a horizontal plane so that an electrode metal element of one of the two pairs may be different from that of the other. That is to say, two consumable electrodes 14 and 15 consisting of pure niobium round bar, which form a first pair, are set in series on an axis with a predetermined distance between the facing ends of the two consumable electrodes, and similarily, two consumable electrodes 16 and 17 consisting of pure titanium round bar, which form a second pair, are set in series with a predetermined distance therebetween as well. The first pair and the second pair are set parallelly on a horizontal plane. The two niobium consumable electrodes 14 and 15, and two titanium consumable electrodes 16 and 17 are connected respectively to direct current power source 18, and to direct current power source 19. Through these positionings, arc 20 between the two niobium consumable electrodes 14, 15, and arc 21 between the two titanium consumable electrodes 16, 17, are generated. Due to heat produced by arcs 20 and 21, each of electrodes 14 and 15, and each of electrodes 16 and 17 are continuously melted at the facing ends of each of electrodes 14 to 17, to form molten drops, the molten drops going down into mold 11. In order to measure distances between two electrodes of each of the two pairs, and consuming speed of electrodes used, detectors (not shown) are installed in respect to electrodes 14 and 15 of the first pair, and to electrodes 16 and 17 of the second pair. In addition, devices 23, 24, 25 and 26, which push, respectively, electrodes 14 and 15, and electrodes 16 and 17 along an axis line, are also installed. Distances between electrodes and melting speeds of each of electrodes of the two pairs can thus be controlled.

Composition of elements of alloy product is controlled by either of the following methods:

(1) electric current is controlled so that decrease speed of an electrode length may become equal in respect to every electrode in operation and sectional area of an electrode is selected in compliance with alloy composition.

(2) With measurement of decrease speed of electrode weight (melting speed) by means of a detector, electric current density or speed of pushing each electrode is individually controlled so that speed of melting electrodes gets a predetermined speed in compliance with alloy composition.

In this embodiment, direct current is used as the electric source, but alternating current can be used as the electric source to melt electrodes. It is preferable to keep an electric arc discharge constant and stable by allowing plural phases of alternating current to be provided, or a plurality of direct currents can be overlapped.

Molten metal 13 in mold 11 is stirred by a magnetic field formed by magnetic coil 12, so that an alloy metal having equiaxed crystal structure or having no segregation is manufactured. In this embodiment, magnetic stirring is applied, but a method of rotating the mold can alternatively be provided. Furthermore, it is also desirable to allow every element contained in the molten metal to be fully homogeneously mixed by delaying solidification of the molten metal by means of heating the surface of the molten metal by using a heat source. The method of heating can be carried out by heating the surface of the molten metal by means of an electron beam. The inside of chamber 10 has only to be of non-oxidizing atmosphere. Therefore, a vacuum atmosphere or inert gas atmosphere is kept in the chamber.

This embodiment is for manufacturing Nb-Ti alloy metal. This method is also effective in manufacturing an alloy consisting two kinds of metal elements which, each, are active and of high melting point, or consisting of two kinds of metal elements each melting point of which is very different from the other element. Ni-Ti alloy metal is the former example, and Al-Ti alloy and Al-Ni alloy are the latter examples. When an alloy consisting of three kinds of metal elements is manufactured, three pairs of electrodes as described above are used for the manufacture.

Furthermore, in the foregoing embodiment, positionings of electrodes can be alternated by other examples. Another example will be given. Two consumable electrodes 14 and 15 consisting of the single and same element i.e. pure niobium round bar, which form a first pair, are arranged with each of their facing end have a downward slope direction and with a predetermined distance between their facing ends above the mold. And similarily, two consumable electrodes 16 and 17 consisting of the single and same element i.e. pure titanium round bar, which forms a second pair, are arranged as mentioned above. The first one pair and the second one pair are parallelly set.

Figure 3:
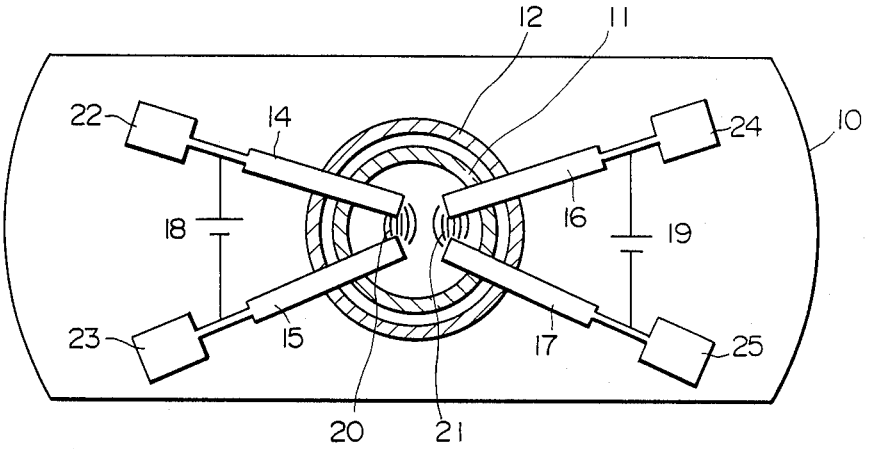
FIG. 3 is a plan view showing another embodiment of a method of the present invention.

According to a further example of positioning, with reference to FIG. 3, two consumable electrodes 14 and 15 consisting of pure niobium round bar, forming a first pair, having their facing ends spaced by a predetermined distance which is less than a distance between the other ends thereof, on a horizontal plane above the mold. And, similarly, two consumable electrodes 16 and 17 consisting a pure titanium round bar, forming a second pair, have their ends arranged as mentioned above. The first one pair and the second one pair are confronted on the horizontal plane.

The present invention, as shown in the above description, effects not only allowing no inclusion of unmelted metal material in the final alloy product but also making it needless to prepare melting material of alloy elements in advance, and, thus, enables to manufacture quality alloy at low cost.

EXAMPLE

Nb-Ti alloy was manufactured by a method of the embodiment shown in FIGS. 1 and 2.

The inside of chamber 10 was kept at a vacuum of $10^{-2}$ Torr. Consumable electrodes 14 and 15 were niobium round bar of 25 mm in diameter and consumable electrodes 16 and 17 were titanium round bar 32.5 mm in diameter. The diameters were determined so that a desired element composition of alloy might be obtained when the melting speed of the Nb-electrodes equaled that of the Ti-electrodes. 4700 ampere direct current between electrodes 14 and 15, and 1000 ampere direct current between electrodes 16 and 17, each, were applied to generate arc 20 and 21 respectively. Owing to the heat of those arcs, electrodes 14 to 17 were melted at their facing ends to allow melted drops therefrom to go into the copper mold 11 of 100 mm in inner diameter, cooled by water. Molten metal 13 was solidified by cooling through mold 11, while stirred in the magnetic field formed by coil 12. Thus, an alloy consisting of 53 wt.% niobium and 47 wt.% titanium was produced. Distances between electrodes 14 and 15, and distances between electrodes 16 and 17 were controlled by devices 22, 23, 24 and 25 to be kept constant. The manufactured alloy was of good quality without segregation and inclusion of unmelted metal material.

What is claimed is:

1. A method for manufacturing an alloy, comprising:

providing a first pair of spaced apart consumable electrodes, each electrode of said first pair consisting essentially of a same first single metal element, the spaced apart electrodes of said first pair having adjacent ends which are spaced apart from each other;

providing a second pair of spaced apart consumable electrodes, each electrode of said second pair consisting essentially of a same second single metal element, the spaced apart electrodes of said second pair having adjacent ends which are spaced apart from each other;

said single metal elements of said first and second pairs being different from each other;

melting said consumable electrodes by generating a respective arc between said spaced apart adjacent ends of said consumable electrodes of each pair of electrodes in a non-oxidizing atmosphere, to cause the consumable electrodes of each pair to be melted at the respective spaced apart adjacent ends of each pair of consumable electrodes; and collecting molten drops of said different single metal elements, produced by said melting, in a mold to form a molten metal in the mold, the molten metal collected in said mold being cast into an alloy consisting essentially of said different single metal elements.

2. The method of claim 1, wherein said electrodes of each of said pairs of electrodes are elongated electrodes having respective longitudinal axes, said electrodes of each pair being arranged in series with their axes aligned, and with a predetermined distance between said spaced apart adjacent ends, said pairs of electrodes being further arranged on a horizontal plane above said mold.

3. The method of claim 1, wherein said spaced apart adjacent ends of at least one pair of said consumable electrodes have a downwardly sloping surface which is arranged at a predetermined distance above said mold.

4. The method of claim 1, wherein said electrodes of said pairs of electrodes are arranged with their adjacent ends spaced by a predetermined distance which is less than a distance between the other ends thereof on a horizontal plane above said mold.

5. The method of claim 1, wherein said step of melting each of the electrodes includes controlling a current density between the electrodes of each of said pairs.

6. The method of claim 5, wherein said melting step further comprises pushing said electrodes of a pair toward each other at a given pushing speed.

7. The method of claim 1, comprising stirring the molten metal in said mold by a magnetic stirring coil surrounding the mold.

8. The method of claim 1, comprising heating the molten metal in said mold by heating the surface of the molten metal by means of heat source.

9. The method of claim 1, wherein said nonoxidizing atmosphere is a vacuum.

10. The method of claim 1, wherein said nonoxidizing atmosphere is an inert gas atmosphere.

11. The method of claim 1, wherein said alloy consists of two of said single metal elements, and is an alloy selected from the group consisting of Nb-Ti alloy, Ti-Al alloy, Ni-Al alloy and Fe-Ti alloy.

12. The method of claim 1, wherein said alloy consists of three different single metal elements.

13. The method of claim 1, wherein said step of melting each of the electrodes includes controlling voltages respectively applied to the electrodes of each pair of electrodes, to thereby control the arc generated and the resulting melting rate.

14. The method of claim 13, wherein the voltages applied to each pair of electrodes are different so as to provide a respective different voltage across the spaced-apart adjacent ends of each pair of electrodes.

15. The method of claim 1, comprising controlling the cross-sectional areas of said electrodes to control the melting rates of said pairs of electrodes.

* * * * *

UNITED STATES PATENT AND TRADEMARK OFFICE

CERTIFICATE OF CORRECTION

PATENT NO. : 4,764,209

DATED : August 16, 1988

INVENTOR(S) : MORI et al

It is certified that error appears in the above-identified patent and that said Letters Patent is hereby corrected as shown below:

Column 1, line 39, after "efficiency" insert -- is --

Column 2, line 51, after "embodiment" insert -- of --

Column 4, line 14, "end" should be -- ends --

Column 4, line 14, "have" should be -- having --

Column 4, line 26, "having" should be -- have --

Signed and Sealed this

Twenty-fifth Day of April, 1989

*Attest:*

DONALD J. QUIGG

*Attesting Officer*

*Commissioner of Patents and Trademarks*